US006298929B1

(12) United States Patent
Cobos Rojas

(10) Patent No.: US 6,298,929 B1
(45) Date of Patent: Oct. 9, 2001

(54) BI-CENTER BIT ASSEMBLY

(76) Inventor: Austreberto F. Cobos Rojas, Ruis Cortinez S14, Colonia Lopez Maleos Villa Hermosa Tab. (MX)

( * ) Notice: Subject to any disclaimer, the term of this patent is extended or adjusted under 35 U.S.C. 154(b) by 0 days.

(21) Appl. No.: 09/457,425

(22) Filed: Dec. 7, 1999

(30) Foreign Application Priority Data

Dec. 10, 1998 (MX) ..... 9810459

(51) Int. Cl.[7] ..... E21B 10/26
(52) U.S. Cl. ..... 175/391; 175/399
(58) Field of Search ..... 175/385, 391, 175/392, 398, 399

(56) References Cited

U.S. PATENT DOCUMENTS

Re. 36,817 * 8/2000 Pastusek et al. ..... 175/391
2,022,735 * 12/1935 Pearce .
3,138,213 6/1964 Brandon .
4,706,765 11/1987 Lee et al. ..... 175/334
5,678,644 10/1997 Fielder ..... 175/391
5,765,653 6/1998 Doster et al. ..... 175/75
5,957,223 * 9/1999 Doster et al. ..... 175/385
5,992,548 * 11/1999 Silva et al. ..... 175/391
6,039,131 * 3/2000 Beaton ..... 175/398

* cited by examiner

*Primary Examiner*—William Neuder
(74) *Attorney, Agent, or Firm*—Baker Botts L.L.P.

(57) ABSTRACT

An improved bi-center drill bit and drill bit assembly includes a cylindrical body having a first diameter section and a smaller second diameter section, each section provided with a threaded end. The cylindrical body includes a longitudinal internal channel with a side channel terminating in a sidewall nozzle. Attached to the external surface of the first diameter section is a rotary cone drill bit with the rotary cone positioned in a trailing position from a stream of drilling fluid from the sidewall nozzle. Two stabilizers are mounted to the cylindrical body substantially opposite from the drill bit to stabilize operation of the bit assembly.

15 Claims, 3 Drawing Sheets

BI-CENTER BIT ASSEMBLY

RELATED APPLICATION

This application claims the benefit of Mexican Patent Application No. 9810459 filed on Dec. 10, 1998.

TECHNICAL FIELD OF THE INVENTION

The present invention relates to drill bits for enlarging the diameter of a bore hole, and more specifically to a bi-center bit passing through a smaller diameter segment of the bore hold for enlarging the bore hole below the smaller diameter segment.

BACKGROUND OF THE INVENTION

In conventional drilling of bore holes for oil and gas recovery, there is often a necessity to isolate different types of formations with casing pipe to prevent cave-in of the bore hole walls and for loss of fluid, both during the drilling operation and recovery operation of the well. Currently, the predominant drill bit used by the well-drilling industry is the tri-cone rotary drill bit for oil and gas wells and water wells.

During a drilling operation, the size of the drill bit is many times limited by the inside diameter of the casing pipe previously introduced into the well. This requires a subsequent drill bit introduced into a well to have an exterior diameter somewhat smaller than the inside diameter of the previously introduced casing pipe, resulting in a bore hole having smaller diameters as the depth of the well proceeds. In drilling a typical well, a large diameter bit is routinely used to drill the upper portion of the hole to a first depth for a first casing string. A smaller diameter bit which will pass through the first casing string is then used to drill to a depth where a second casing string is introduced into the well. This continues until the depth of the well is achieved. In addition to requiring the use of various size bits with the attendant costs of drill bits and operational costs, the result is a bore hole having an effective diameter governed by the smallest diameter bit used in the drilling operation.

Heretofore, the drilling industry has utilized an eccentric bit, or a bi-center bit, to enlarge a bore hole below a tighter undersized segment, such as a previously introduced section of casing pipe. An eccentric bit includes an extended or enlarged cutting portion which, when the bit is rotated about its axis, produces an enlarged bore hold. A bi-center bit heretofore in use by the drilling industry employs two longitudinally spaced bit sections with laterally offset axes. The first axis is the center of the pass-through diameter, that is, the diameter of the smallest bore hole that the bi-center bit will pass through. The second axis is the axis of the hole as the bit is rotated.

Examples of bi-center bits are disclosed in U.S. Pat. Nos. 4,706,765 and 5,765,653.

SUMMARY OF THE INVENTION

In accordance with the present invention, there is provided an improved bi-center rotary cone bit having at least one cutter for enlarging a bore hole after passing through a restricted section, such as casing pipe.

Further, the improved bi-center bit of the present invention includes a cylindrical body having an internal fluid channel and at least one drill bit mounted to one side of the cylindrical body. The drill bit includes at least one cutting element. A nozzle in the surface of the cylindrical body communicates with the internal fluid channel with the nozzle positioned to direct a stream of fluid ahead on the cutting element of the drill bit. To stabilize the bi-center bit against vibration, a stabilizer is mounted to the cylindrical body in a position substantially opposite that of the drill bit.

BRIEF DESCRIPTION OF THE DRAWINGS

A more complete understanding of the bi-center bit assembly of the present invention may be had by reference to the following detailed description when taken in conjunction with the accompanying drawings wherein.

DETAILED DESCRIPTION OF THE INVENTION

Figure 1:
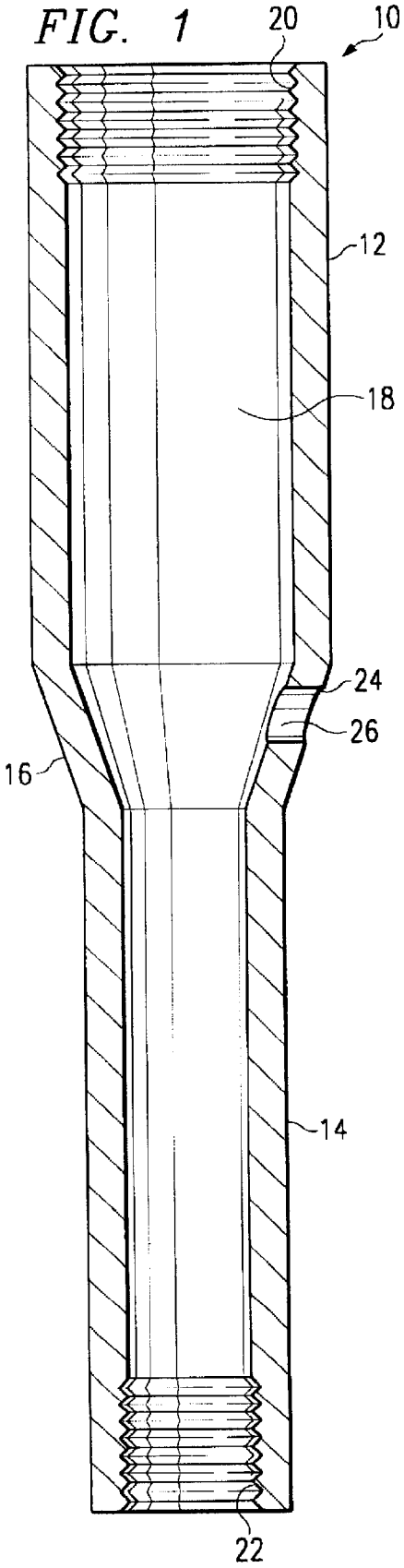
FIG. 1 is a sectional view of the cylindrical body of the bi-center bit of the present invention.

Referring to FIG. 1, there is shown a cross section of a cylindrical body 10 for use with the bi-center drill bit assembly of the present invention. The cylindrical body 10 includes a first diameter section 12 and a smaller second diameter section 14 where the sections 12 and 14 are joined by a taper section 16. Internally, the cylindrical body 10 comprises a channel 18 for passage of drilling fluid from a drill string (not shown) connected to the threaded end 20 to a drill bit (not shown) connected to the threaded end 22. In the taper section 16, there is a nozzle 24 receiving drilling fluid from the channel 18 by means of a passage 26.

Figure 2:
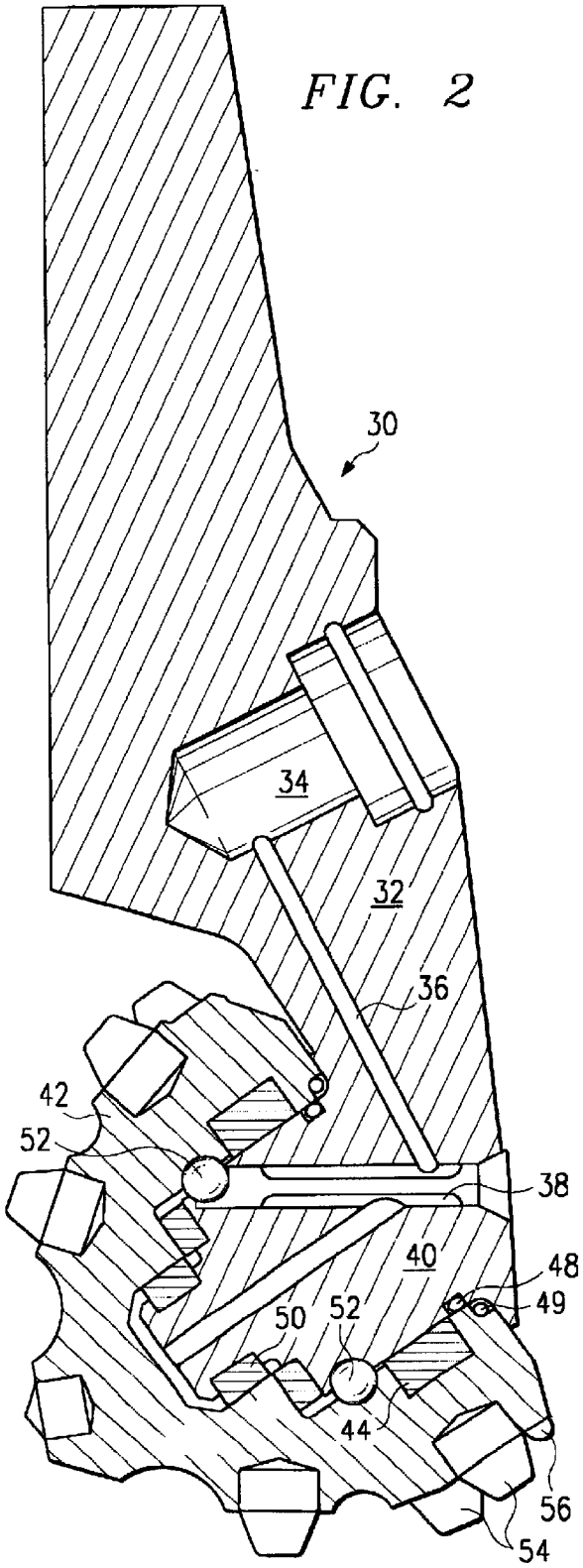
FIG. 2 is a sectional view of a rotary cone drill bit for use with the bi-center bit of the present invention.

Referring to FIG. 2, there is shown a sectional view of a rotary cone bit for use with the bit assembly of the present invention. It will be understood that more than one rotary cone bit may be employed in the bit assembly of the present invention. Included as part of the rotary cone bit 30 is a leg portion 32 having a lubrication system comprising a reservoir 34, a passage 36, and a passage 38. The passage 38 has an opening into the cavity formed between a journal pin 40 and the inside surface of a cutter cone 42. A sleeve bearing 44 rotatably supports the cutter cone 42 on the journal pin 40. In an annular groove formed by assembly of the cutter cone 42 onto the journal pin 40, there is provided seals 48 and 49 to restrict the inflow of abrasive particle to the bearing surface between the sleeve bearing 44 and the journal pin 40. Also assembled onto the journal pin 40 is a bearing ring 50. The cutter cone 42 is assembled onto the bearing pin 40 and held in place by conventional means such as ball bearings 52 rotatably supported in bearing races.

Extending from the surface of the cutter cone 42 are a plurality of cutting teeth 54 and gage teeth 56 along a gage row of the cutter cone 42.

Figure 3:
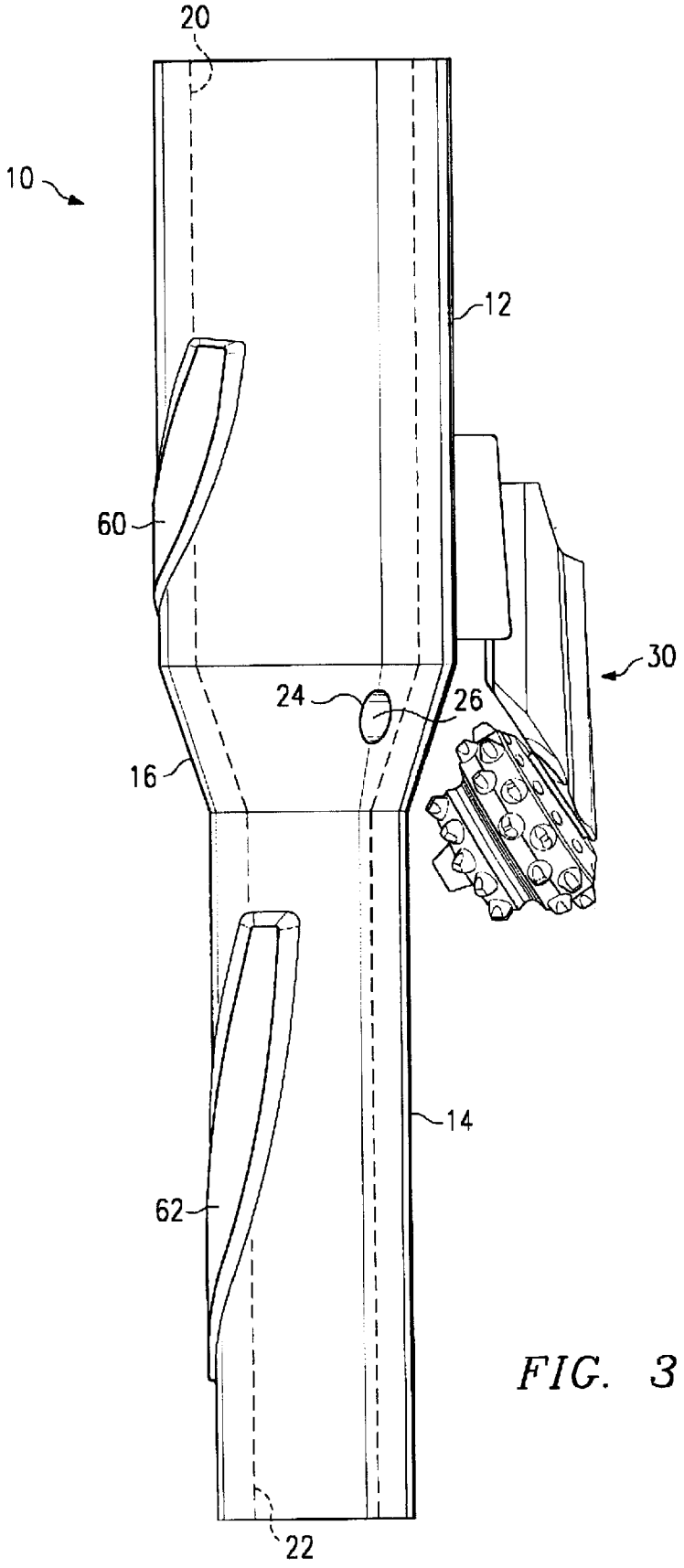
FIG. 3 is a pictorial view of the bi-center bit showing the drill bit of FIG. 2 mounted to the cylindrical body of FIG. 1.

Referring to FIG. 3, there is shown an assembly of a cylindrical body 10 and a drill bit 30 into a bi-center drill bit for drilling a bore hole having a diameter greater than the diameter of a restriction through which the drill bit assembly will pass. As shown, the drill bit 30 is mounted to the outside surface of the first diameter section 12 of the cylindrical body 10. The drill bit 30 is mounted to the first diameter section 12 in a position such that drilling fluid from the nozzle 24 is directed ahead of the rotary cone 42 to flush chips removed by operation of the drill bit from the bore hole in accordance with conventional operation. To counterbalance the weight of the drill bit 30, stabilizers 60 and 62 are mounted to the outside surface of the cylindrical body 10 in a position substantially opposite from the position of the drill bit 30.

Figure 4:
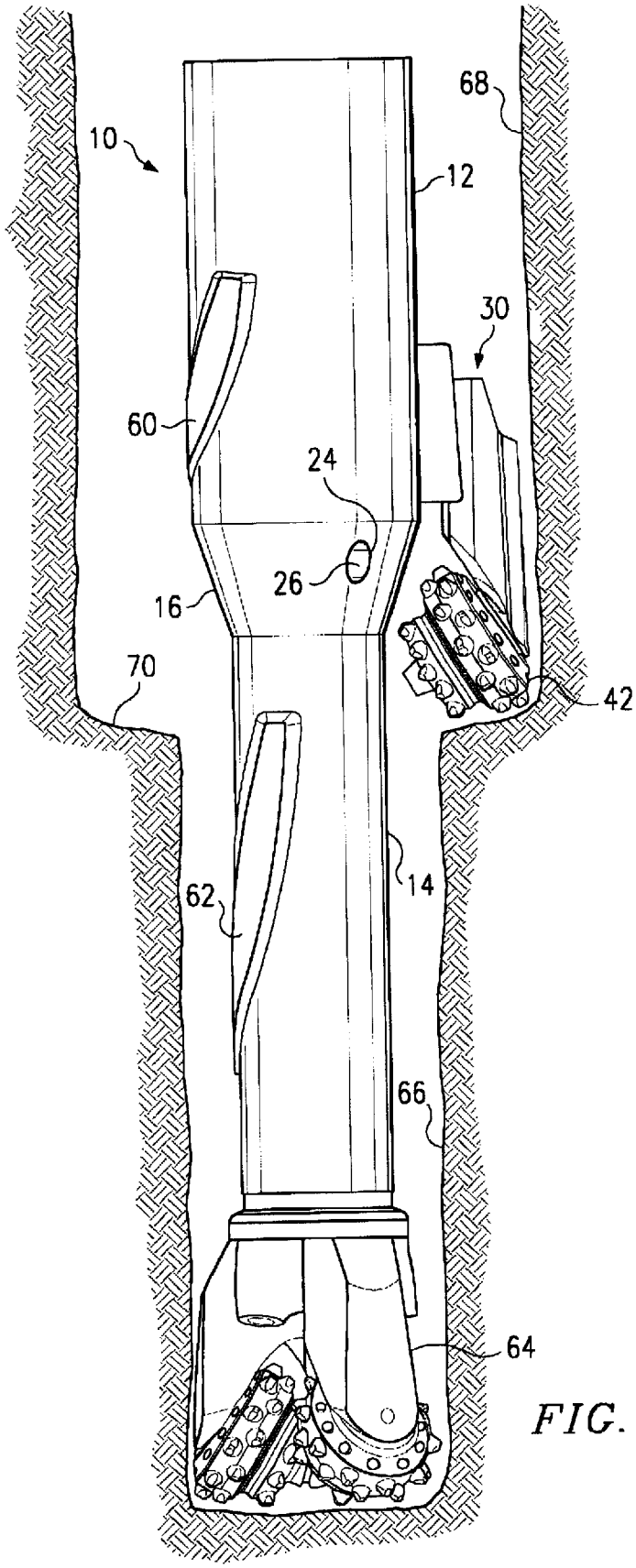
FIG. 4 is a schematic illustration showing use of the bi-center bit assembly of the present invention.

Referring to FIG. 4, there is schematically illustrated a drilling operation utilizing the bi-center drill bit of the present invention. The cylindrical body 10 is attached to a drill string (not shown) by means of the threaded end 20 for rotation in accordance with conventional drilling procedures. Attached to the distal end of the cylindrical body 10 is a conventional rotary cone bit 64 or other conventional drill bit. Operation of the drill bit 64 or other conventional drill bit in accordance with conventional techniques results in the formation of a bore hole 66 having a dimension determined by the size of the drill bit. At the same time that the drill bit 64 is forming the bore hole 66, the drill bit 30 rotating with the cylindrical body 10 enlarges the bore hole 66 to a bore hole 68 having a diameter determined by rotation of the cylindrical body 10 about its longitudinal axis.

In operation, the bi-center drill bit of the present invention is lowered into the bore hole without turning, thus allowing the bit to pass through a restriction determined by the outer diameter of the cylindrical body 10 plus the extension resulting from the drill bit 30 and the stabilizer 60. This dimension is significantly less than the dimension of the bore hole 68 as illustrated in FIG. 4. The drilling operation begins utilizing the weight of the drill string and rotation thereof, along with drilling fluid to crush and grind the bottom of the bore hole and the shoulder area 70 as a result of operation of the rotary cone 42 of the drill bit 30. The drill bit 64, while continuing to deepen the bore hole, also serves as a guide or pilot bit to center the cylindrical body 10 and stabilize rotation of drill bit 30.

Although only one embodiment of the invention has been illustrated in the accompanying drawings and described in the foregoing detailed description, it will be understood that the invention is not limited to the embodiment disclosed, but is capable of numerous modifications without departing from the scope of the invention as claimed.

What is claimed is:

1. A bi-center drill bit, comprising:

a cylindrical body comprising a first diameter section, a second smaller diameter section and a taper section joining the first diameter section and the second smaller diameter section, the cylindrical body having an internal fluid channel;

at least one drill bit mounted to said cylindrical body, said drill bit having at least one cutter positioned at the taper section of the cylindrical body; and a nozzle extending through a surface of said cylindrical body and communicating with the internal fluid channel, said nozzle positioned to direct a stream of fluid ahead of the at least one cutter of said drill bit during operation thereof.

2. The bi-center drill bit as set forth in claim 1 further comprising a stabilizer mounted to said cylindrical body in a position substantially opposite from the mounting of said drill bit.

3. The bi-center drill bit of claim 1 wherein said cylindrical body comprises the second smaller diameter section having a threaded end for supporting a second drill bit.

4. The bi-center drill bit of claim 3 further comprising a first stabilizer mounted to the first diameter section of said cylindrical body in a position substantially opposite from said drill bit mounted to the first diameter section; and a second stabilizer mounted to the second smaller diameter section of said cylindrical body in a position substantially opposite from said drill bit mounted to the first diameter section.

5. The bi-center drill bit of claim 1, wherein the second drill bit comprises a rotary cone bit.

6. The bi-center drill bit of claim 3 further comprising a second drill bit supported by the threaded end of the second smaller diameter section.

7. A bi-center drill bit assembly, comprising:

a cylindrical body comprising a first diameter section, a second smaller diameter section having a threaded end, and a taper section joining the first diameter section and the second smaller diameter section, said cylindrical body having an internal fluid channel extending through the first diameter section and the second smaller diameter section;

a drill bit mounted to the first diameter section of said cylindrical body, said drill bit having at least one cutter positioned at the taper section of the cylindrical body;

a nozzle extending through a surface of said cylindrical body and communicating with the internal fluid channel, said nozzle positioned to direct a stream of fluid ahead of the at least one cutter of said drill bit; and a second drill bit mounted to the threaded end of said cylindrical body.

8. The bi-center drill bit assembly of claim 7 further comprising:

a first stabilizer mounted to the external surface of the first diameter section of said cylindrical body in a position substantially opposite from said drill bit mounted to the first diameter section; and a second stabilizer mounted to the external surface of the second smaller diameter section of said cylindrical body in a position substantially opposite from said drill bit mounted to the first diameter section.

9. A bi-center drill bit, comprising:

a cylindrical body having an internal fluid channel;

at least one drill bit mounted to said cylindrical body, said drill bit having at least one cutter;

a nozzle extending through a surface of said cylindrical body and communicating with the internal fluid channel, said nozzle positioned to direct a stream of fluid ahead of the at least one cutter of said drill bit during operation thereof;

a first stabilizer mounted to a first diameter section of said cylindrical body in a position substantially opposite from said drill bit mounted to the first diameter section; and a second stabilizer mounted to a second smaller diameter section of said cylindrical body in a position substantially opposite from said drill bit mounted to the first diameter section.

10. The bi-center drill bit of claim 9, wherein the cycindrical body comprises a taper section, wherein the drill bit comprises a rotary cone cutter positioned at the taper section of the cylindrical body.

11. The bi-center drill bit of claim 9, wherein the cylindrical body comprises the second smaller diameter section having a threaded end for supporting a second drill bit; and a second drill bit supported by the threaded end of the second smaller diameter section.

12. The bi-center drill bit of claim 11, wherein the second drill bit comprises a rotary cone drill bit.

13. A bi-center drill bit assembly, comprising:

a cylindrical body comprising a first diameter section and a second smaller diameter section having a threaded end, said cylindrical body having an internal fluid channel extending through the first diameter section and the second smaller diameter section;

a drill bit mounted to the first diameter section of said cylindrical body, said drill bit having at least one cutter;

a nozzle extending through a surface of said cylindrical body and communicating with the internal fluid channel, said nozzle positioned to direct a stream of fluid ahead of the at least one cutter of said drill bit;

a drill bit mounted to the threaded end of said cylindrical body;

a first stabilizer mounted to the external surface of the first diameter section of said cylindrical body in a position substantially opposite from said drill bit mounted to the first diameter section; and a second stabilizer mounted to the external surface of the second smaller diameter section of said cylindrical body in a position substantially opposite from said drill bit mounted to the first diameter section.

14. The bi-center drill bit of claim 13, wherein the drill bit mounted to the first diameter section comprises a rotary cone drill bit.

15. The bi-center drill bit of claim 14, wherein the second drill bit comprises a rotary cone bit.

* * * * *

UNITED STATES PATENT AND TRADEMARK OFFICE

CERTIFICATE OF CORRECTION

PATENT NO. : 6,298,929 B1
DATED : October 9, 2001
INVENTOR(S) : Austreberto F. Cobos Rojas It is certified that error appears in the above-identified patent and that said Letters Patent is hereby corrected as shown below:

Column 4,
Line 54, after "the", delete "cycindrical", and insert -- cylindrical --.

Signed and Sealed this

Twenty-sixth Day of March, 2002

*Attest:*

*Attesting Officer*

JAMES E. ROGAN
*Director of the United States Patent and Trademark Office*